United States Patent [19]

Jedziniak

[11] Patent Number: 4,624,510

[45] Date of Patent: Nov. 25, 1986

[54] STORAGE ASSEMBLY FOR DATA PROCESSING DEVICE

[76] Inventor: Francis J. Jedziniak, 2352 W. 227th St., Torrance, Calif. 90501

[21] Appl. No.: 692,910

[22] Filed: Jan. 17, 1985

Related U.S. Application Data

[63] Continuation-in-part of Ser. No. 340,115, Jan. 18, 1982, Pat. No. 4,493,267.

[51] Int. Cl.[4] ..... A47B 49/00

[52] U.S. Cl. ..... 312/252; 248/418; 312/198

[58] Field of Search ..... 248/418, 553, 551; 312/198, 252; 108/140, 141

[56] References Cited

U.S. PATENT DOCUMENTS

| | | | |
|---|---|---|---|
| 1,693,770 | 12/1928 | Wilson | 248/418 |
| 3,541,256 | 11/1970 | Anders | 248/1 A |
| 3,724,798 | 4/1973 | Lucasey | 248/418 |
| 4,223,542 | 9/1980 | Basseches | 248/553 X |
| 4,458,961 | 7/1984 | Browning | 248/1 B |

FOREIGN PATENT DOCUMENTS

| | | | |
|---|---|---|---|
| 3132015 | 10/1982 | Fed. Rep. of Germany | 108/27 |

*Primary Examiner*—James T. McCall
*Attorney, Agent, or Firm*—I. Michael Bak-Boychuk

[57] ABSTRACT

A shelfing system is disclosed herein for use in storing data processing devices, said shelfing system including cooling blowers in the surfaces thereof for cooling the electronic equipment stored therein. The shelfing system, furthermore, is pivotally fastened for convenient maintenance access with the pivotal motion thereof restrained by a locking mechanism. Alternatively the shelving system may include locks in the various panels thereof which support a pivoted turntable to which the monitor of the data processing system is attached. This turntable includes a resilient panel compressed within the bearing which then imposes friction in the motion thereof for fixing the monitor alignment.

2 Claims, 23 Drawing Figures

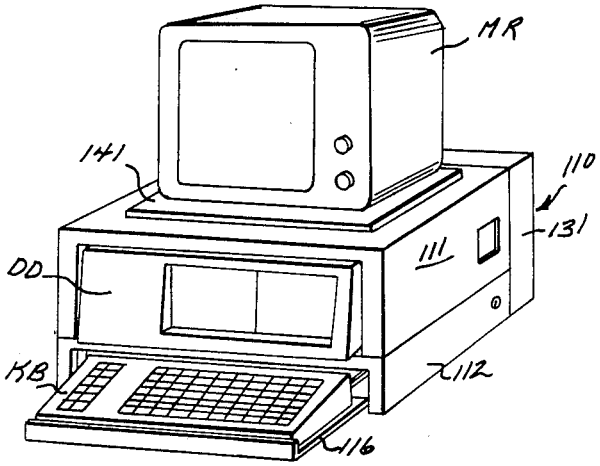
FIG. 10
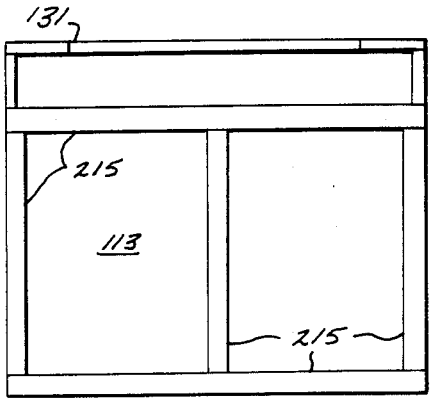
FIG. 12
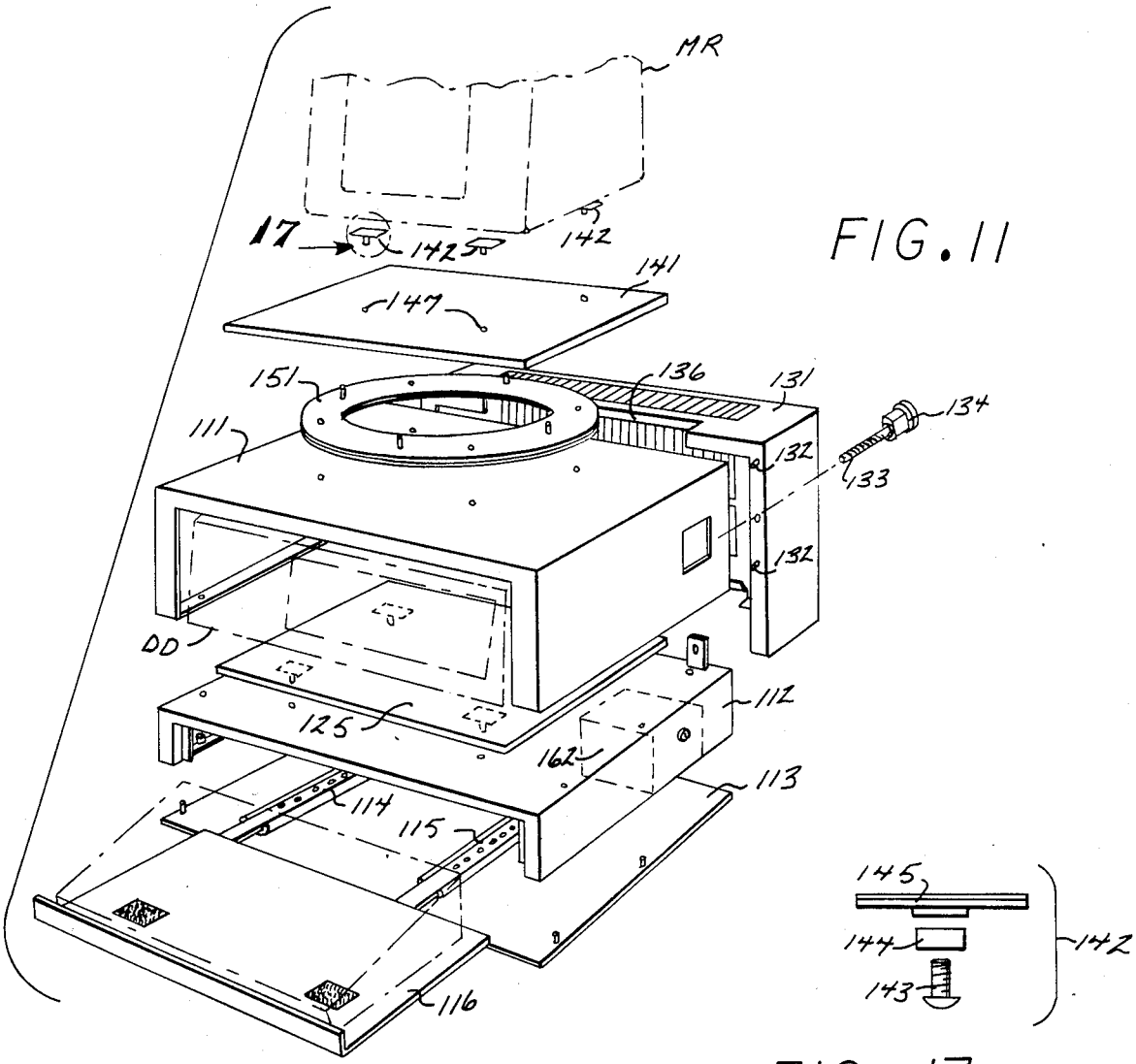
FIG. 11
FIG. 17

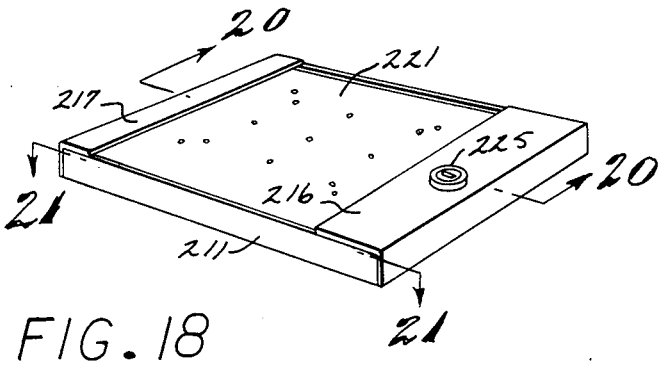
FIG. 18
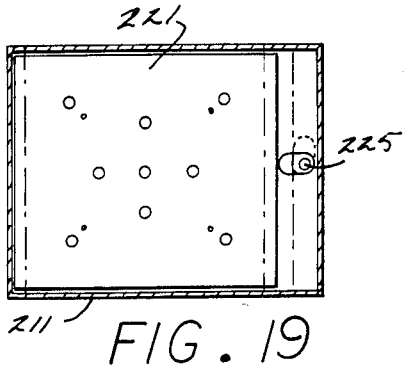
FIG. 19
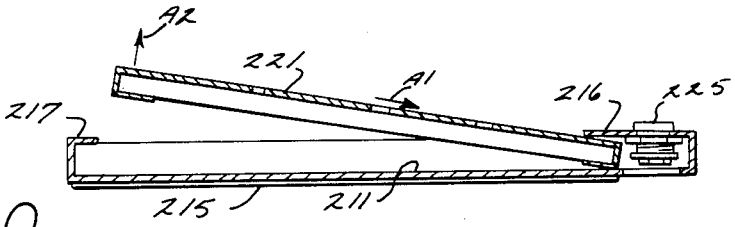
FIG. 20
FIG. 21
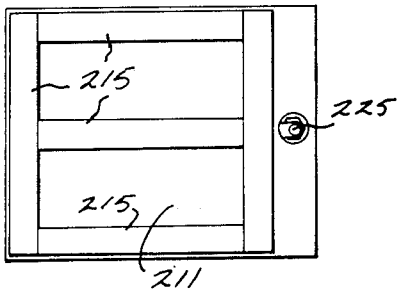
FIG. 22
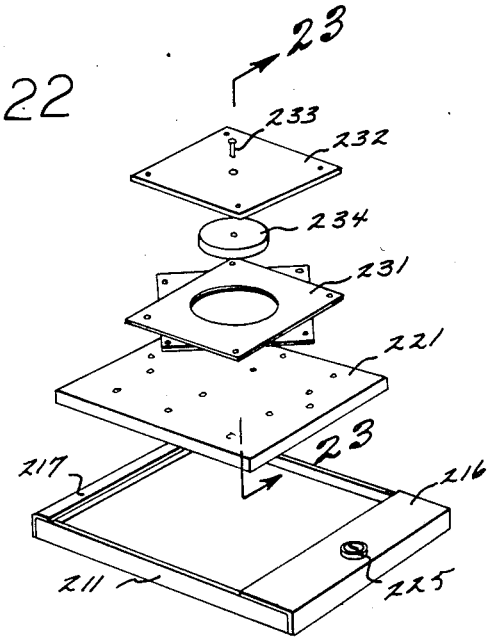
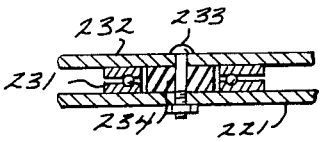
FIG. 23

STORAGE ASSEMBLY FOR DATA PROCESSING DEVICE

RELATIONSHIP TO PRIOR APPLICATIONS

This application is a continuation-in-part of U.S. application Ser. No. 340,115 for "Securable Storage Assembly for Data Processing Device" filed by the same applicant Francis J. Jedziniak on Jan. 18, 1982 now U.S. Pat. No. 4,493,267.

BACKGROUND OF THE INVENTION

1. Field of the Invention

The present invention relates to storage assemblies, and more particularly to shelfing systems conformed for use with data processing devices.

2. Description of the Prior Art

Storage of electronic equipment in convenient alignment for periodic use typically entails the resolution of various competing perameters thus rendering the eventual solution often less then optimum. For example, high density storage must necessarily contemplate the cooling requirements of any electronic device which must resolve itself with the security of the installation and cost. Concurrently appearance factors and convenience of storage of various incidental articles must be considered in order to render the whole package as acceptable to the eventual consumer as possible. For this reason various techniques have been sought in the past to simplify the structure resolving these competing functions and it is one such structure uniquely suited for data processing systems that is disclosed herein.

SUMMARY OF THE INVENTION

Accordingly it is the general purpose and object of the present invention to provide a storage system for data processing devices which, in convenient form, provides both facility in use and ventilation for cooling.

Other objects of the invention are to provide a storage system for electronic devices which may be conveniently converted to a secured configuration.

Yet additional objects of the invention are to provide a storage system for storing data processing devices which is easy to produce, requires few parts and is conveniently used.

Briefly these and other objects are accomplished within the present invention by providing a sheet metal bracket, generally conformed in the manner of an inverted "U" and having the spread between the legs thereof substantially equal to the width of a data processing keyboard unit. The bracket, on the interior thereof, is joined to a transverse shelf cooperating with the top of the bracket to define a space conformed to receive one or more disc packs used in conjunction with the keyboard system. On the upper surface the bracket provides a support for a video unit, thus storing in combination all the necessary elements for a data processing system. The bracket itself may include at the bottom edges thereof outwardly turned projections which engage a plurality of footpads between which an L-shaped bookstand may be inserted. Furthermore, one lateral surface of the bracket may be provided with a cooling fan which upon proper orientation of the bracket can be aligned with the cooling inlets in the keyboard device. In this form the shelf assembly may be pivotally mounted to a base plate supported on roller slides. A lock mechanism engages a lock plate against the bracket and the slide thus hiding any possible access to the working apertures in the equipment against unauthorized entry.

This set of features is uniquely adapted for installing data processing systems in schools or other areas where security is of significance. Furthermore, this set of features combine uniquely to provide ease of maintenance since only one locking sequence is necessary in order to obtain full access to all of the working areas.

In further embodiments the shelfing unit may comprise several chambers each respectively conformed to house a seperate component of a modular data processing system, each chamber including lock assemblies for securing the module. The upper surface of the unit may then include a rotary monitor support securable by fasteners which are accessible only upon unlocking the cavity on which the rotary support is mounted.

This rotary support may, furthermore, comprise a mount for an integral data processing assembly and may include friction devices for controlling the alignment of this assembly.

Thus a secure storage system is provided which conveniently adapts to the various data processing packages now avaible in the marketplace.

BRIEF DESCRIPTION OF THE DRAWINGS

FIG. 10 is a perspective illustration of yet another embodiment of the inventive storage unit;

FIG. 11 is a perspective illustration, seperated by parts, of the unit shown in FIG. 10;

FIG. 12 is a bottom view of the unit shown in FIG. 10;

FIG. 17 is a side view detail, in parts, of a fastener useful herein;

FIG. 18 is a perspective view of a further example of the invention herein;

FIG. 19 is a top view of the unit shown in FIG. 18;

FIG. 20 is a side view, in section, taken along line 20—20 of FIG. 18;

FIG. 21 is a bottom view taken along line 21—21 of FIG. 18;

FIG. 22 is a perspective view, seperated in parts, of a variant of the unit shown in FIG. 18; and FIG. 23 is a detail section view taken along line 23—23 of FIG. 22.

DESCRIPTION OF THE SPECIFIC EMBODIMENT

Figures 1, 2, 3, 4, 5, 6, 7, 8, 9:
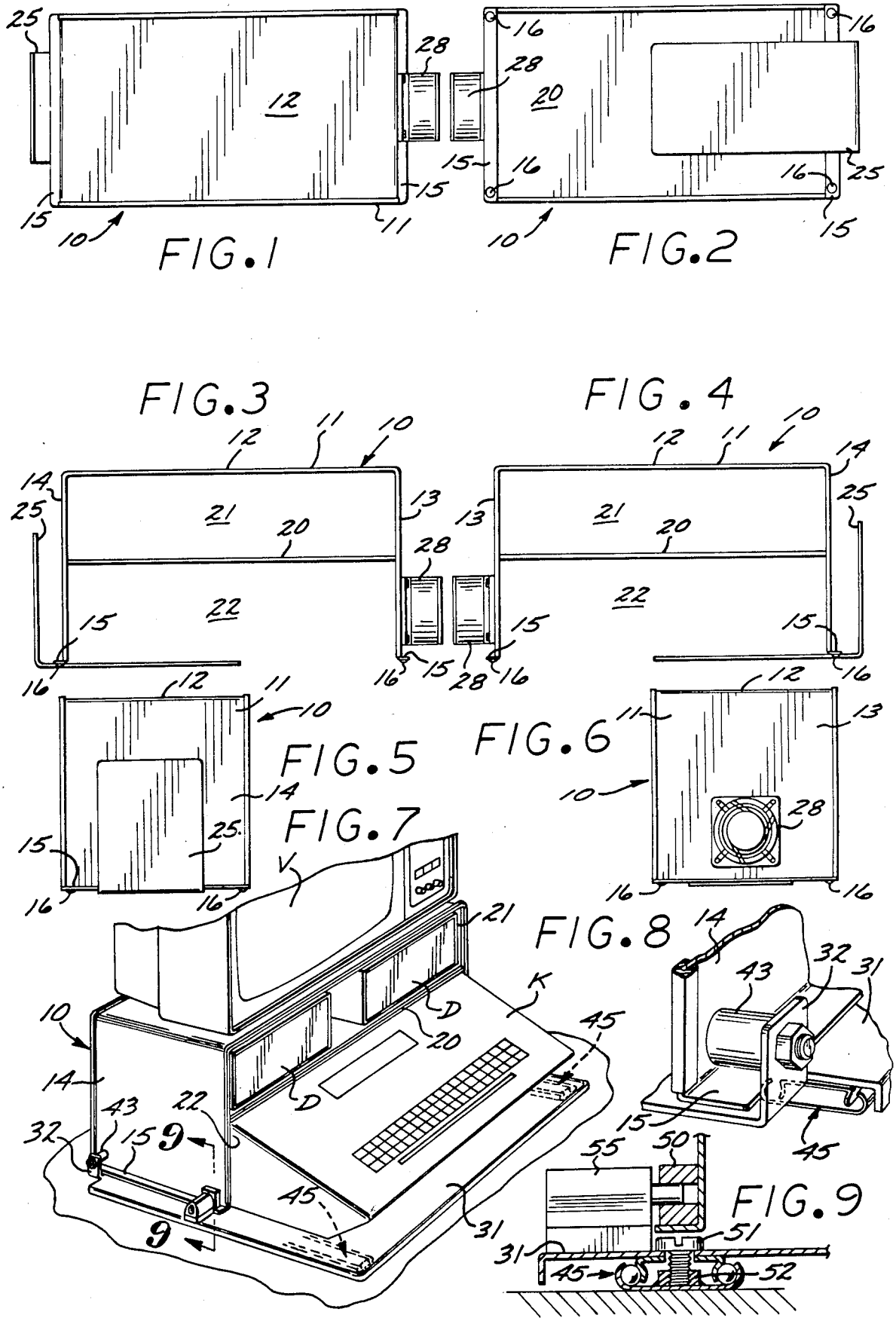
FIG. 1 is a top view of an inventive shelfing unit constructed according to the disclosure herein.
FIG. 2 is a bottom view of the inventive shelfing unit shown in FIG. 1.
FIG. 3 is a front view of the shelfing unit shown in FIG. 1.
FIG. 4 is a rear view of the shelfing unit shown in FIG. 1.
FIG. 5 is one side view of the shelfing unit shown in FIG. 1.
FIG. 6 is another side view, illustrating the venting arrangement in the inventive shelfing unit disclosed in FIG. 1.
FIG. 7 is an assembly view, in perspective, illustrating the shelfing unit shown in FIGS. 1–6 as assembled into a secured configuration.
FIG. 8 is a detail view, in perspective, illustrating the pivot connection useful with the shelfing unit disclosed herein.
FIG. 9 is a front view detail of the seeured installation of the shelfing unit according to the present invention herein.
Figure 13:
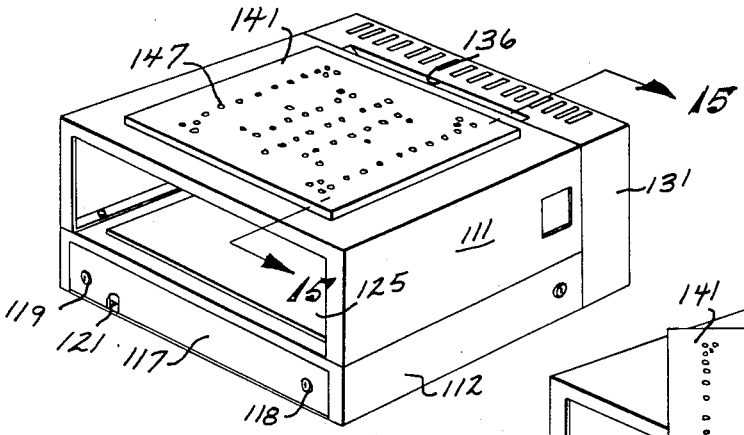
FIG. 13 is a perspective illustration of a further variant of the unit shown in FIG. 10.
Figure 14:
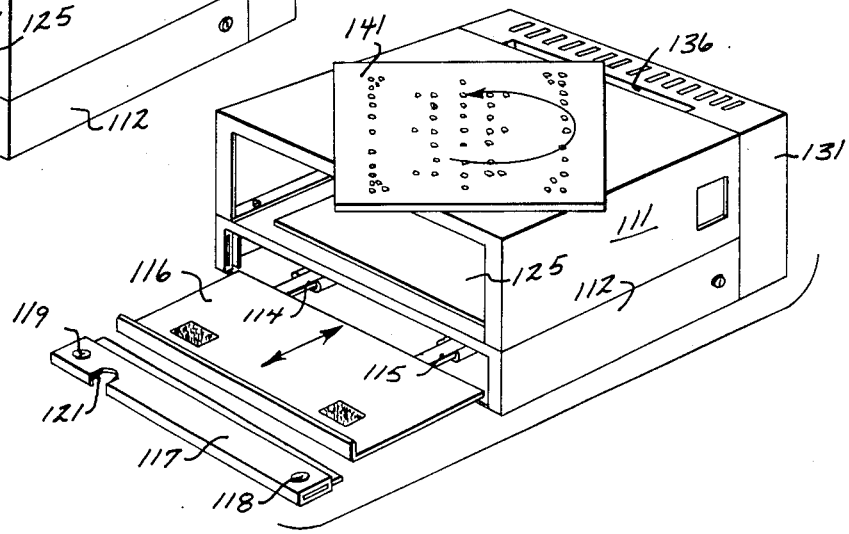
FIG. 14 is a perspective illustration, seperated by parts of the unit shown in FIG. 13.
Figure 16:
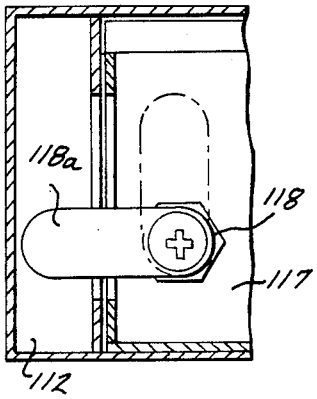
FIG. 16 is a detail view, in section, taken along line 16—16 of FIG. 15.
Figure 15:
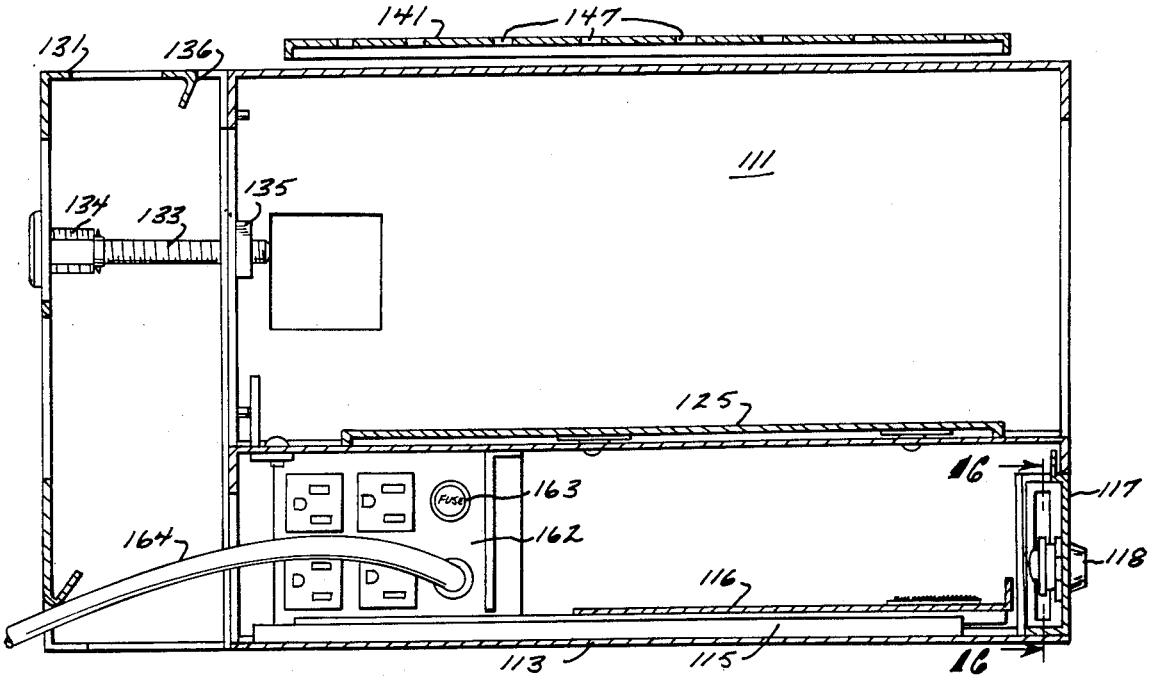
FIG. 15 is a side view, in section, taken along line 15—15 of FIG. 13.

As shown in FIGS. 1-6 the inventive shelfing unit, generally designated by the numeral 10, comprises a sheet metal panel of substantially rectangular plan form convolved to form a hat or inverted U section to define a brace 11 having a horizontal flat surface 12 supported by two vertical surfaces 13 and 14 which, at the free edges thereof, are bent into outwardly extending ridges 15 to which rubber foot pads 16 are adhesively attached. Legs 13 and 14 at a point subjacent surface 12, are joined by a horizontal panel or shelf 20 thus defining an upper storage cavity 21 and a lower storage cavity 22. When supported on a flat surface the spacing between foot pads 16 allows for the insertion of one leg of an L-shaped book rack 25 which is retained against pivotal motion by any electronic equipment received in cavity 22. Furthermore, the lateral leg or surface 13 may include a fan assembly 28 which draws air from the environment and directs it into cavity 22.

Cavity 22 may be dimensioned to receive the keyboard unit of any data processing device shown herein as keyboard unit K which when inserted will align the vent openings thereof adjacent the outlet of the fan assembly 28. Thus the air drawn by the fan assembly 28 will now circulate through the interior of the keyboard assembly cooling any heat sources included therein. In turn, the upper cavity 21 may be conformed to receive one or more peripheral devices such as disc pack D which in normal use provides the necessary memory space for the keyboard articulated data processing system.

The foregoing data processing compliments may be further expanded to include a video screen on which any information associated with the processing is displayed. This video screen V may be stored on the upper surface 12 thus providing all of the necessary features of a data processing device in one useful assembly arrangement.

The foregoing shelfing unit 10, according to the illustrations in FIGS. 7, 8 and 9, may be placed onto a flat surface 31 provided with vertical tabs 32 at the rear edge thereof. Tabs 32 are separated relative each other by the dimensions equal to the separation across ridges 15 to provide through spacers 43 pivot points for the shelfing unit 10. More specifically, tabs 32 may be joined to the lateral surfaces 13 and 14 by way of fasteners 33. In this configuration the outwardly bent lips or ridges 15 overlie the surface 31 which, in turn, is supported on slides 45 dimensioned to the same spread. The surface 31 together with the laterally extending ridges 15 may then be locked against sliding translation by a screw 51 extending into a bore formed in one of the slides 45. This screw 51 extends downwardly from a point subjacent ridge 15 to engage a boss 52 formed in the fixed runner of the slide. A plate 50 attached to the leg 14, in turn, may be engaged by a lock assembly 55 secured to surface 31 to lock the shelf unit 10 against pivoting, thus preventing the withdrawal of the screw 51 until it is unlocked. In this manner the video screen V, the disc packs D and the key-board may be secured to the shelfing unit, precluding unauthorized withdrawal.

Thus the shelfing 10, while useful on its own, may be conformed for secured installation without loss of integrity of operative features. This retention assures a secured enclosure for the data processing equipment hereinbefore mentioned which while thus secured is fully accessible to the user. In this form all the mecessary access to ventilation and maintenance is retained while insuring the equipment against unauthorized loss or withdrawal.

A further embodiment, illustrated in FIGS. 10 through 17 provides securing functions for systems comprising several components. Thus, for example, a system including a monitor MR, a disc drive DD, and keyboard KB may be stored in a storage unit 110 comprising an upper rectangular housing 111 attached to the edges of a lower rectangular housing 112 which is supported on an attachment plate 113 secured to a table or desk top. Plate 113 may include a pair of roller slides 114 and 115 supporting a tray 116 conformed to receive the keyboard KB. This tray 116 may engage a lock strip 117 shaped to fit the front opening of the lower housing 112 the ends of the lock strip including key assemblies 118 and 119 which lock to the proximate edges of the housing. Thus when retracted within the interior of housing 112 the keyboard KB is secured against unauthorized taking and when extended the keyboard may be removed from the tray, the tray then retracted and locked by the lock strip with the keyboard cable passing into housing 112 through a cutout 121 in the lock strip.

The cable thus can pass to the rear of housing 112 into the upper housing 111 to engage thereat to the disc drive DD. This disc drive DD is secured to a mounting plate 125 at the top of the lower housing 112, the mounting plate thus forming the base surface of the housing 111. Once again the fasteners fixing the mounting plate and the upper housing are accessible only upon the removal of the various locked panels.

At the rear both the upper and lower housings 111 and 112 attach to a rectangular back cover 131 aligned by pegs 132 and fixed by threaded shafts 133 extending from locks 134. Each shaft 133 is fixed to its lock 134 mounted in the rear cover 131 to pass into a nut plate 135 in the edge of housing 111 and is theadably engaged thereto upon insertion of a key. When thus attached the rear cover 131 presents an edge cutout 136 against the upper edge of housing 111 to form a slot through which the leads from the disc drive DD pass to the monitor MR.

The monitor MR may be mounted onto a rotary support panel 141 by way of a plurality of fastener assemblies 142 each including a screw 143 engaging a nut 144 fixed to an adhesively backed flat segment 145 which is pressed against the bottom of the monitor. This fastener assembly can then be inserted through one or more of several openings 147 formed in panel assembly 141, the opening pattern being further selected to align with fastener openings in commercially available monitors.

Panel 141 is then attached to a turntable assembly 151, more particularly to the upper race thereof. The lower race of the turntable 151 can then be fixed to the top of housing 111 to form a rotary base for the monitor.

At the same time power cabling from the monitor MR, disc drive DD, and the keyboard KB is connected to a multiplug outlet 162 fixed in a rear corner of housing 112 and provided with a key interlock 163 which interrupts power in a manner known in the art. This power source may then be connected by a cable 164 to any conventional power outlet (not shown).

Accordingly a modular system may be conveniently secured and when use is selected keys are inserted into locks 118 and 119 to turn tabs 118*a* (and 119*a*) out of engagement with the edge of housing 112.

For commercial data processing systems comprising a single integrated structure a securing assembly is illustrated in FIGS. 18 through 23. As shown in these figures a rectangular base structure 211 is adhesively attached by strips 215 to the top of a work surface, in a manner similar to plate 113, structure 211 including a raised periphery which forms inwardly directed lips 216 and 217 at the front and rear thereof. In this fashion pockets are formed at the front and rear of the structure into which the front and rear edges of a support panel 221 are received. This support panel is sized to slide under lip 216 in the direction of arrow A1 and thereafter to pivot along arrow A2 into the structure 211. Once in position a key assembly 225 is turned in lip 218 to turn a key tab 226 against the edge of the panel. The panel 221 is thus secured in the interior of structure 211 and can not be withdrawn.

Fixed centrally on panel 221 is a turntable bearing 231 on which a support surface 232 is mounted. This support surface is pierced by a center fastener 233 which also pierces through a resilient pad 234 within the interior of bearing 231 to pass into panel 221. Thus by selecting the torque on fastener 233 more or less intimate contact is made with pad 234, controlling the rotary friction. In this manner any data processor fixed to surface 232 may be conveniently turned and held thereat by the friction.

Obviously many modifications and changes may be made to the foregoing description without departing from the spirit of the invention. It is therefore intended that the scope of the invention be determined solely on the claims appended hereto.

What is claimed is:

1. A storage system for storing a complement of data processing devices, comprising:

a support plate conformed for attachment to a work surface;

a lower rectangular housing attached to said support plate, said lower housing including a front opening and a slide extendable from the interior thereof through said front opening;

an upper rectangular housing mounted on said lower housing;

a lock strip selectively engageable in said front opening;

a rear cover selectively securable to said upper and lower housing; and a turntable mounted on said upper housing including a resilient pad compressed between the adjacent surfaces of said turntable and said upper housing for producing friction.

2. A storage structure for supporting a data processing device, comprising:

a rectangular base provided with a front and rear lip directed towards each other;

a support plate conformed for sliding fit subjacent said front and rear lips;

a lock selectively articulated for opposing sliding withdrawal of said support plate from beneath said front and rear lips; and a turntable mounted on one surface of said base conformed for attachment to said data processing device.

* * * * *